US005205423A

United States Patent [19]

Ota

[11] Patent Number: 5,205,423

[45] Date of Patent: Apr. 27, 1993

[54] SYNTHETIC RESIN BOTTLE-SHAPED CONTAINER HAVING BOTTOM SUPPORT

[75] Inventor: Akiho Ota, Funabashi, Japan

[73] Assignee: Yoshino Kogyosho Co., Ltd., Tokyo, Japan

[21] Appl. No.: 860,275

[22] Filed: Apr. 1, 1992

Related U.S. Application Data

[63] Continuation of Ser. No. 663,938, Mar. 5, 1991, abandoned.

[30] Foreign Application Priority Data

Jul. 7, 1989 [JP] Japan ..... 1-80237[U]

[51] Int. Cl.[5] ..... B65D 23/00

[52] U.S. Cl. ..... 215/12.1; 215/1 C; 215/100 R; 220/630

[58] Field of Search ..... 215/1 C, 100 R, 12.1; 220/630

[56] References Cited

U.S. PATENT DOCUMENTS

| | | | |
|---|---|---|---|
| 2,305,896 | 12/1942 | Prati | 215/12.1 |
| 3,722,725 | 3/1973 | Khetani et al. | 215/12.1 X |
| 3,838,789 | 10/1974 | Cvacho | 220/630 X |
| 3,927,782 | 12/1975 | Edwards | 215/100 R |
| 4,294,374 | 10/1981 | Ames | 220/630 X |
| 4,326,638 | 4/1982 | Nickel et al. | 215/12.1 |
| 4,442,944 | 4/1984 | Yoshino et al. | 215/12.1 X |
| 4,573,597 | 3/1986 | Adams et al. | 215/1 C X |
| 4,919,284 | 4/1990 | Tiedemann et al. | 215/12.1 |
| 4,955,491 | 9/1990 | Marshall et al. | 215/1 C X |
| 4,955,492 | 9/1990 | Behm et al. | 215/1 C X |

FOREIGN PATENT DOCUMENTS

| | | | |
|---|---|---|---|
| 497177 | 9/1955 | Italy | 215/12.1 |
| 697360 | 11/1965 | Italy | 215/12.1 |
| 51-30068 | 3/1976 | Japan . | |
| 53-9576 | 3/1978 | Japan . | |
| 57-49444 | 3/1982 | Japan . | |
| 58-3445 | 1/1983 | Japan . | |
| 60-38498 | 11/1985 | Japan . | |
| 1175048 | 12/1969 | United Kingdom | 215/1 C |

*Primary Examiner*—Sue A. Weaver
*Attorney, Agent, or Firm*—Oliff & Berridge

[57] ABSTRACT

This invention relates to a synthetic resin bottle-shaped container comprising a bottle-shaped main body and a pedestal body for providing stable self-standing capability to the main body. The bottle-shaped main body (1) is made of a biaxially oriented blow-molded synthetic resin material. A center portion (6) of a bottom portion (3) of the main body (1) is depressed inwardly and a curved outer peripheral surface area of the bottom portion (3) is formed with a wide press-fit recess (4) to be engaged with a pedestal body (7). The pedestal body (7) is a short cylindrical portion with an outer diameter substantially equal to that of the bottle portion (2) of the main body (1) and comprises an upper half portion (9) for engaging with the press-fit recess (4) of the bottom portion (3) and a lower half portion (8) for accommodating the bottom portion (3) so that the lowest end of the pedestal body (7) is positioned below the lowest end of the bottom portion (3). The pedestal body (7) is easily and exactly engaged with the main body (1) and also provides a high protection capability against external impact to the bottom portion (3) of the main body (1).

9 Claims, 2 Drawing Sheets

SYNTHETIC RESIN BOTTLE-SHAPED CONTAINER HAVING BOTTOM SUPPORT

This is a continuation of application Ser. No. 07/663,938 filed Mar. 5, 1991, now abandoned.

BACKGROUND OF THE INVENTION

This invention relates to a relatively large synthetic resin bottle-shaped container.

Biaxially oriented blow-molded bottle-shaped containers made of acrylonitrile resin or polyethylene terephthalate resin are popularly used because of their mechanical strength, transparency and other excellent properties.

Such biaxially oriented blow-molded bottle-shaped containers are generally divided into tow groups: those having a semispherically bulged bottom for an enhanced internal pressure resistivity and provided with a base cup that serves as a stand and those having a bottom with an internally depressed central area that serves as a stand for self-standing without a base cup.

A bottle-shaped body having a self-standing capability is advantageous over a bottle-shaped body provided with a base cup in terms of easy cleaning, sterilization, molding and assembling as well as of overall appearance.

However, a self-standing bottle-shaped body has only a small bottom area that supports the bottle-shaped body relative to the cross sectional area of a body portion and therefore is less stable when ti stands by itself.

More specifically, when a circular peripheral portion of the bottom that serves as a stand for the bottle-shaped body is formed by depressing the central area of the bottom by blow-molding, the circular peripheral portion of the bottom is inevitably located nearer to the center of the bottom than the outer circumference of the body portion. This fact results in the reduced bottom area that supports the bottle-shaped body in an upright condition.

Moreover, when a high internal pressure is applied to such a self standing bottle-shaped body, the bottom portion forming a stand is subjected to a relatively large expansion, which in turn adversely affects the self-standing capability of the bottle-shaped body to a significant extent. Such an expansion can results in an deformation.

On the other hand, in a bottle-shaped body provided with a base cup for keeping it upright, the height of the base cup is required to be of a relatively large size in order to accommodate an outwardly projecting semispherical bottom portion of the bottle-shaped body so that the overall appearance of the bottle-shaped container will be aesthetically poor because of the disproportional large base cup. Moreover, the bottom of such a bottle-shaped body can not protect expansion and deformation when a large internal pressure is applied thereto.

Besides, a biaxially oriented blow-molded bottle-shaped container made of acrylonitrile resin is insufficiently resistive to shocks applied to the bottom and can produce cracks and fissures on the bottom when it is inadvertently dropped.

SUMMARY OF THE INVENTION

In view of the above described problems, it is therefore the object of the present invention to provide a bottle-shaped container having a depressed area at the center of the bottom provided with a pedestal useful as a self-standing means wherein the bottom has an enhanced and stable self-standing capability, protects any expansion and deformation, and at the same time is highly resistive to shocks.

According to the invention, the above object is achieved by providing a synthetic resin bottle-shaped container comprising a biaxially-oriented blow-molded bottle-shaped body having a relatively long press-fit recess on a curved outer peripheral surface area of a curved bottom portion and a cylindrical pedestal body having a straight and cylindrical upper half portion with an outer diameter substantially equal to that of a body portion of the bottle-shaped container. The upper portion has a curved inner peripheral surface closely engaged with the press-fit recess. The cylindrical pedestal body further has a hollow pedestal-shaped lower half portion for accommodating the bottom of the bottle-shaped body portion so that a lowest end of the lower half portion of the pedestal body is positioned below a lowest end of the bottom portion of the body portion.

The press-fit recess is preferably formed in progressively deeper toward a lower end thereof on the curved outer peripheral surface area of the bottom portion, and the matching curved inner peripheral surface of the upper half portion of the cylindrical pedestal body is tapered toward an upper end thereof. Therefore, the bottom of the bottle-shaped body is closely engaged with the pedestal body by simply pressing downward the bottle-shaped body until the curved outer peripheral surface area of the bottom of the bottle-shaped body is completely in contact with the matching curved inner peripheral surface area of the upper half portion of the cylindrical pedestal body.

When the press-fit recess formed on the curved outer peripheral surface area of the bottle-shaped body is so configured that the recess is progressively deeper toward the lower end thereof and a relatively high projecting portion is provided at the lower end of the press-fit recess, a press-fit rib projecting at a lower end of the curved inner peripheral surface area of the cylindrical upper half portion of the pedestal body is closely engaged with the high projecting portion to produce a firm and stable engagement between the bottle-shaped body and the pedestal body.

With such an arrangement, since the curved outer peripheral surface of the bottom of the bottle-shaped body is closely engaged with the inner surface of the pedestal body, an enhanced inner pressure is supported by the inner surface of the pedestal body, and the bottom of the bottle-shaped body is protected against any undesirable expansion and deformation due to such an enhanced inner pressure.

Besides, since a lowest end of the lower half portion of the pedestal body is always positioned below a lowest end of the bottom of the bottle-shaped body, the lowest end surface of the pedestal body provides a firm and stable support for the bottle-shaped body regardless of expansion and deformation of its bottom.

Moreover, since the pedestal body is not integral with the bottle-shaped body and the pedestal body serves as a shock absorber that effectively protects the bottom of the bottle-shaped body from cracks and fissures, the bottom of the bottle-shaped body has sufficiently high sensitivity to any shocks even if the bottle-shaped container is made of acrylonitrile resin and it is dropped from a high position.

Now the present invention will be described in greater detail by referring to the accompanying drawings that illustrate a preferred embodiment of the invention.

PREFERRED EMBODIMENT

Figure 1:
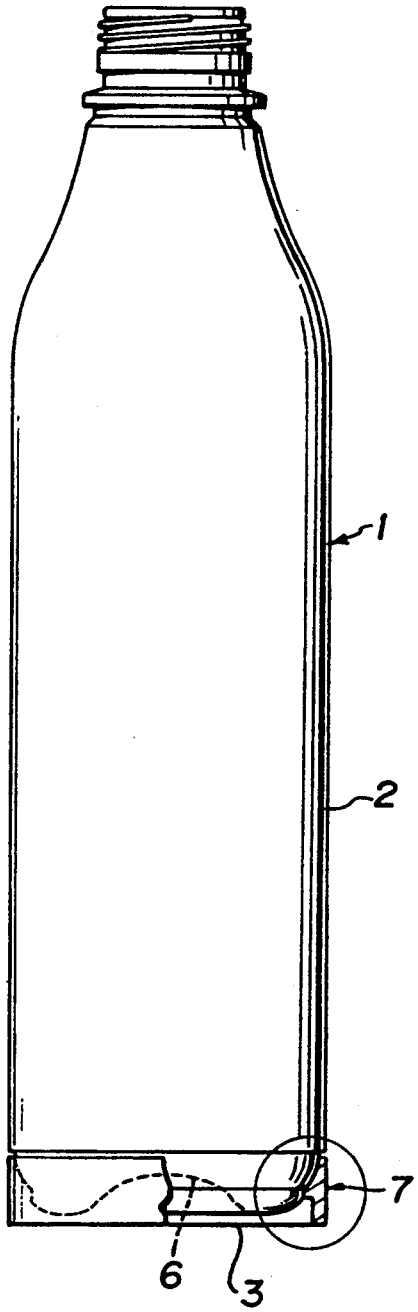
FIG. 1 is a front view of the embodiment showing the pedestal body in partial longitudinal cross section.
Figure 2:
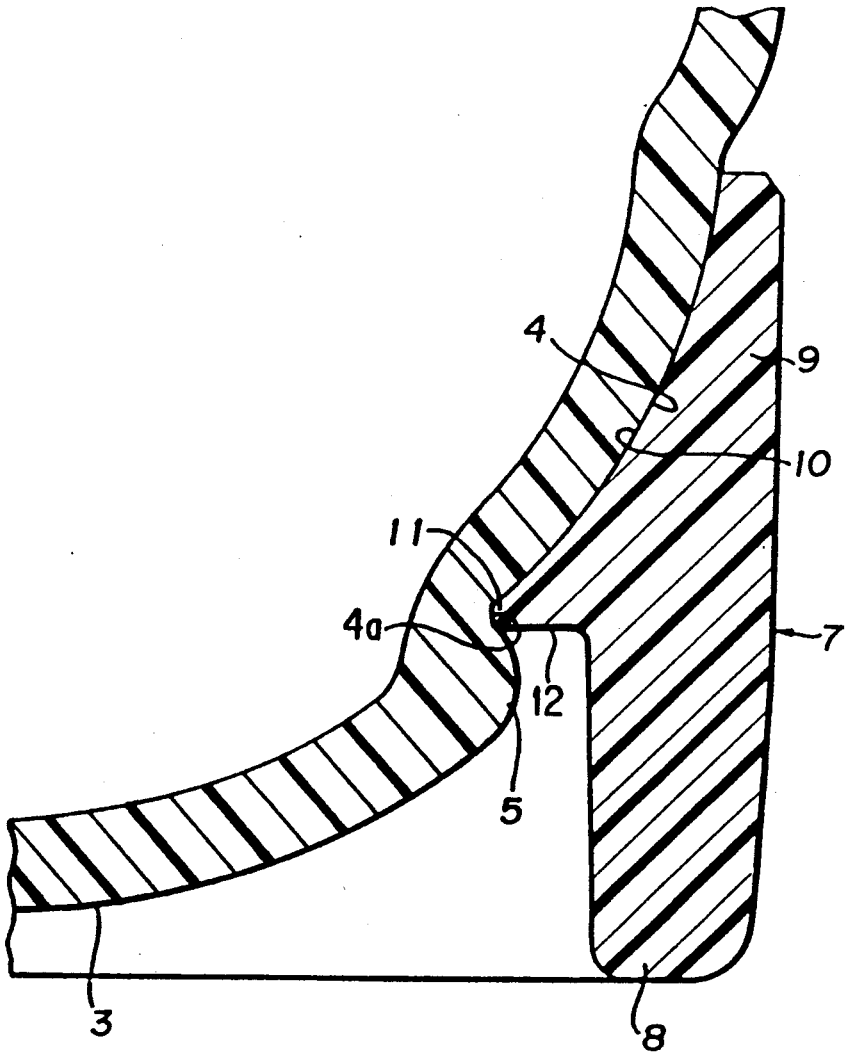
FIG. 2 is an enlarged longitudinal sectional view showing only the encircled area in FIG. 1.

In FIGS. 1 and 2, reference numeral 1 denotes a biaxially-oriented blow-molded bottle-shaped body made of synthetic resin having a bottom portion 3 integrally formed at a lower end of body portion 2 of the bottle shaped body 1. The bottom portion 3 has a depressed area 6 at the center thereof and a peripheral projecting area surrounding the depressed area which can serve as a stand or support structure in a conventional hollow bottle-shaped body of the self-standing type.

Now referring to FIG. 2, a relatively long press-fit recess 4 is formed on the outer peripheral surface area of a curved surface of the bottom portion 3 near the body portion 2 and is so configured that the depth of recess 4 is progressively increased as it approaches a lower end thereof, thus forming an annular groove 4*a*. A relatively high projecting portion 5 is formed at the lower end of the press-fit recess 4.

On the other hand, a pedestal body 7 for supporting the bottle-shaped body 1 is formed as a whole in the form of a short and straight cylinder, i.e., having a substantially vertical outer perimeter, and an upper half cylindrical portion 9 of the pedestal body 7 is provided with a curved inner surface area 10 matching the outer peripheral surface area of the press-fit recess 4. Since both curved surfaces have a same radius of curvature, they are closely engaged with each other in a press-fit manner when assembled. A press-fit rib 11 is projected at a lower end of the curved inner surface area 10 of the upper half cylindrical portion 9 of the pedestal body 7 and is closely engaged with the lower end of the press-fit recess 4 when assembled.

With such an arrangement, a step 12 is formed at the boundary between the press-fit cylindrical upper half portion 9 and the lower half pedestal portion 8 of the pedestal body 7, such that the projecting portion 5 does not constitute any obstacle when the bottle-shaped body 1 and the pedestal body 7 are assembled.

The press-fit rib 11 is so sectionally constructed in a sharp top shape that it can be resiliently deformed. The curved inner surface area 10 is so tapered toward an upper end thereof that it provides a guide surface for properly engaging the bottle-shaped body 1 with the pedestal body 7. The press-fit rib 11 can be resiliently deformed and can easily pass over the projecting portion 5 for engagement of the bottle-shaped body 1 and the pedestal body 7 when they are assembled together.

Because of the engagement between the rib 11 and the projecting portion 5, the pedestal body 7 is strongly fitted to the bottom portion 3 of the bottle-shaped body 1 once they are assembled.

The pedestal body 7 is made of a synthetic resin material which is highly resistive against shocks and therefore can provide satisfactory protection for the bottle-shaped body 1 against external shocks even when the bottom portion 3 of the bottle-shaped body 1 is made of acrylonitrile resin.

Because of the construction described above, the present invention provides the following advantages.

Firstly, since the pedestal body is formed in the form of a short and straight cylinder having an outer diameter substantially identical with that of the body portion of the bottle-shaped container, a flat bottom surface of the lower end of the pedestal body provides the stable support for the bottle-shaped body in its upright position.

Secondly, since the overall height of the pedestal body is only slightly greater than that of the bottom portion having a depression at the center thereof, the pedestal body has a sufficiently reduced height relative to that of the elongated bottle-shaped main body. Consequently, the pedestal body does not provide poor impression of the container in appearance.

Thirdly, since the pedestal body is tightly press fitted to the recess forming the outer peripheral area of the bottom portion of the bottle-shaped body, it can effectively prevent any expansion and deformation of the bottom portion occurring due to an enhanced internal pressure. Consequently, the resistance against the inner pressure of the bottle-shaped body having a depressed central area at the bottom portion can be considerably increased.

Additionally, since the bottle-shaped body is closely engaged with the pedestal body by a simple press-fit operation, the two bodies can be assembled without any difficulty. Moreover, since the two bodies are conveniently and mutually guided to a proper position, they can be accurately assembled.

Finally, since the pedestal body is made of a highly shock-absorbing synthetic resin material, it can effectively protect the bottom portion of the bottle-shaped body from external impacts, and prevent the bottle-shaped body from damages when the container is dropped even if the container is made of a material having a relatively poor shock resistivity such as acrylonitrile resin.

What is claimed is:

1. A synthetic resin bottle-shaped container comprising:

a biaxially-oriented blow-molded bottle-shaped body having a body portion with a diameter and a curved bottom portion, said curved bottom portion having an inwardly concave bottom and an outer peripheral outwardly convex surface extending between the concave bottom and body portion forming an outwardly convex press-fit recess, said convex press-fit recess extending circumferentially around said bottom portion and longitudinally from said body portion to an annular groove located between the concave bottom and the convex press-fit recess of said bottom portion, wherein a high-projecting portion extends circumferentially around said concave bottom below said annular groove radially outwardly from said convex press-fit recess; and a pedestal body for supporting said bottle-shaped body having an exterior surface and an inner surface, said inner surface including an upper concave portion and a lower pedestal portion with a press-fir rib therebetween, said upper concave portion being shaped to abut and substantially entirely cover said convex press-fit recess, said press-fit rib engaging said annular groove and being retained therein by said high projecting portion, said lower pedestal portion extending around and below said bottom portion.

2. The synthetic resin bottle-shaped container of claim 1, wherein said exterior surface of said pedestal body is substantially cylindrical.

3. The synthetic resin bottle-shaped container of claim 1, wherein said exterior surface of said pedestal body has a diameter generally equal to the diameter of the body portion of the bottle-shaped body.

4. The synthetic resin bottle-shaped container of claim 1, wherein said inner surface further comprises an annular step extending radially outward from said inner surface towards said exterior surface, said annular step being located between said upper concave portion and said lower pedestal portion.

5. The synthetic resin bottle-shaped container of claim 1, wherein said upper concave portion tapers inwardly.

6. The synthetic resin bottle-shaped container of claim 1, wherein said lower pedestal portion has a generally cylindrical interior surface.

7. The synthetic resin bottle-shaped container of claim 1, wherein said press-fit recess is indented from said body portion.

8. The synthetic resin bottle-shaped container of claim 1, wherein the concave bottom forms a central depressed area indented longitudinally with respect to said bottle-shaped body.

9. The synthetic resin bottle-shaped container of claim 1, wherein said press-fit rib is resilient.

* * * * *